United States Patent [19]

Nagasaki et al.

[11] Patent Number: 4,677,260

[45] Date of Patent: Jun. 30, 1987

[54] CAM OPERATED SWITCH

[75] Inventors: Takeshi Nagasaki, Mie; Koichi Sawada, Matsusaka, both of Japan

[73] Assignee: Nakagawadenkasangyo Kabushikikaisha, Mie, Japan

[21] Appl. No.: 841,983

[22] Filed: Mar. 20, 1986

[30] Foreign Application Priority Data

Apr. 8, 1985 [JP] Japan ..... 60-73957

[51] Int. Cl.[4] ..... H01H 19/62; H01H 43/10

[52] U.S. Cl. ..... 200/6 BB; 200/27 R; 200/38 R; 200/38 B; 200/144 R; 200/153 LB; 200/283

[58] Field of Search ..... 200/27 R, 27 B, 38 R, 200/38 B, 38 BA, 38 C, 38 CA, 153 LA, 283, 144 B, 284, 6 B–6 C, 153 LB

[56] References Cited

U.S. PATENT DOCUMENTS

| | | | |
|---|---|---|---|
| Re. 29,158 | 3/1977 | Cartier et al. | 200/38 B |
| 4,381,432 | 4/1983 | Cushing | 200/38 B |
| 4,525,608 | 6/1985 | Cushing | 200/38 R |
| 4,531,028 | 7/1985 | Stout et al. | 200/38 R |
| 4,560,846 | 12/1985 | Klopp et al. | 200/38 R |
| 4,587,389 | 5/1986 | Willigman | 200/38 B X |

*Primary Examiner*—J. R. Scott

*Attorney, Agent, or Firm*—Pollock, Vande Sande and Priddy

[57] ABSTRACT

A rotatable cam operated switch having a cam whose peripheral surface constitutes a cam surface. A guide groove is formed along the entire periphery of the cam surface. A first contact plate closer to the cam and a second contact plate farther from the cam are provided on the peripheral side of the cam. The first contact plate has a first part which extends towards the cam which has a flat surface which is formed such that the dimension thereof in the direction parallel to the axis of the cam is made small, while the dimension thereof perpendicular to the axis is larger, to increase rigidity and preclude bending of the plate towards the cam, thereby resulting in more stable electric contact. Additionally, a second part of the first contact plate projects away from the cam and has a flat surface which is rotated by 90° with respect to the flat surface of the first part, and which serves as a terminal for a plug-in connector.

4 Claims, 20 Drawing Figures

FIG.12
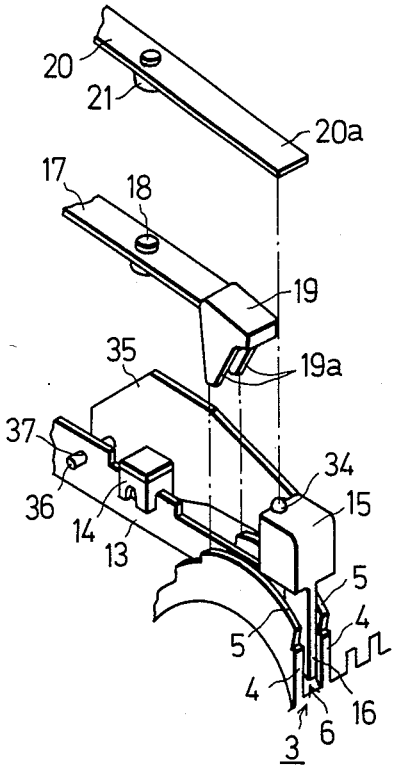
FIG.14A
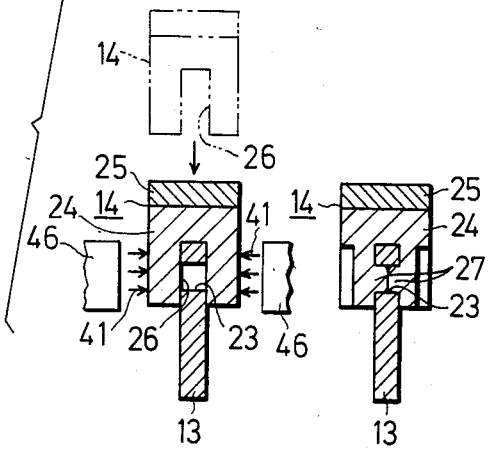
FIG.14B
FIG.13
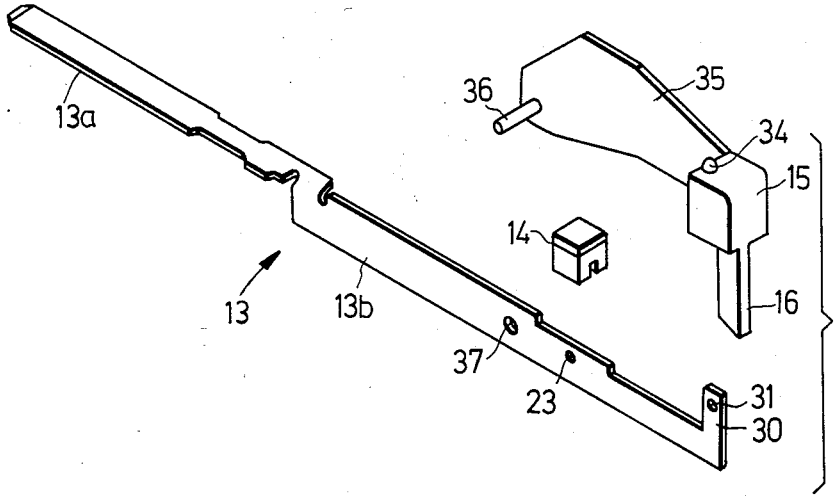

CAM OPERATED SWITCH

BACKGROUND OF THE INVENTION

1. Field of the Invention

The present invention relates to a cam operated switch which is so designed that a switch driven by the cam performs ON-OFF or switchover operations by the rotation of the cam.

2. Description of the Prior Art

As a conventional cam operated switch of this type, one having the structure shown in FIG. 18 is known. In other words, in the cam operated switch shown in FIG. 18, a first contact plate 51 and a second contact plate 52 are disposed on the side of the periphery of a rotatable cam 50. The contact plates 51, 52 have a smaller thickness in the direction of arrows 53, 54, and a greater width in the direction of an arrow 54'. In addition, the second contact plate 52 is formed of an elastic material, and has an urging force in the direction of the arrow 53, a driven member 55 installed at the distal end of the second contact plate 52 being in contact with the peripheral surface of the cam 50. When the cam 50 rotates and causes the driven member 55 to slip down from the high step portion of the cam 50 to a recess 50*a*, the contact 52*a* of the second contact plate 52 comes into contact with the contact 51*a* of the first contact plate 51. When the driven member 55 is raised from the recess 50*a* to the high step portion, the contact 52*a* is removed from the contact 51*a*.

A cam operated switch having the aforementioned contact plates is also known, for example, in the specification of U.S. Pat. No. 3,727,015.

Further, in the construction of the cam operated switch disclosed in the above prior-art patent, three switch blades (corresponding to contact plates 13, 17, 21 of the present application) are each formed by a single plate, and the intermediate portion of each of the switch blades is buried in a terminal block (corresponding to a retainer 11 of the subject application). In addition, in each switch blade, the projection extending from the terminal block to the cam side is moved by the cam in the radial direction of the cam, and the projection extending from the terminal block in the opposite direction serves as a terminal.

In the cam switch having the above-described arrangement, when the second contact plate 52 moves in the direction of the arrow 53 and causes the contact 52*a* to come into contact with the contact 51*a*, as described above, there is a possibility that the first contact plate 51 is bent in the direction of the arrow 54 by the pressing force thereof, and the contacting pressure of both contacts 52*a*, 51*a* becomes insufficient. When the contacting pressure becomes insufficient, faulty electrical conductance may possibly result between the contact plates 51, 52.

Meanwhile, when the second contact plate 52 moves in the opposite direction and causes the contact 52*a* to move away from the contact 51*a*, the first contact plate 51 moves toward the side of the second contact plate 52 due to the springing-back force of the bent first contact plate 51. As a result, the separating distance between the contacts 52*a*, 51*a* becomes insufficient. If this separating distance is small, an arc may be established between the contacts 52*a*, 51*a*, thereby making an electrical shut-off between the contact plates 51, 52 insufficient.

More specifically, an example of the conventional cam operated switches is disclosed in U.S. Pat. No. 3,752,944, for instance. This cam switch is composed of plural parallel-arranged cams and plural switches corresponding to the number of the cams. Each switch includes a passive blade adjacent to the cam (corresponding to the first contact plate 13 of the present invention) and an active blade remote from the cam (corresponding to the second contact plate 17 of the present invention). These passive and active blades are each formed by a single plate, and each intermediate portion is buried in the wafer (corresponding to the retainer 11 of the present invention). In the active blade, the projection extending from the wafer toward the cam side is moved to and fro toward the passive blade in response to the cam motion, so as to be brought into pressure contact with the passive blade or separated therefrom. In the passive and active blades of each switch, the projection extending from the wafer toward the other side is a plate terminal connectable to a plug-in type connector. A number of plate terminals are all arranged in parallel along the direction of the plate surface. Therefore, the height dimension of the connector connected to these terminals is small.

Further, in the cam operated switch disclosed in the above U.S. patent, a depending spacer is mounted on the passive blade so as to ride on the cam drum in order to eliminate the problem involved in the cam operated switch shown in FIG. 18 of the present application. Therefore, the contact pressure generated when the active blade is in pressure contact with the passive blade is received by the cam drum via the passive blade and the depending spacer, so that a brake force is applied to the cam drum owing to a friction generated between the cam drum and the depending spacer. However, since the passive blade is prevented from being bent in the above-mentioned arrow direction on the basis of the urging force of the active blade, a stable electric conduction can be attained between the active blade and the passive blade.

SUMMARY OF THE INVENTION

Accordingly, an object of the present invention is to provide a cam operated switch which is capable of moving the second contact plate toward and away from the first contact plate in response to the concave and convex portions of the cam surface as the cam rotates, and of causing the contacts provided to both contact plates to repeat the reciprocating motion of contacting and separating from each other.

Another object of the present invention is to provide a cam operated switch which, when the contact of the second contact plate comes into contact with the contact of the first contact plate, is capable of obtaining a sufficient contacting pressure between the two simultaneously upon the contact between the two contacts, thereby attaining a positively conductive state therebetween.

A still further object of the present invention is to provide a cam operated switch which, when the contact of the second contact plate is separated from the contact of the first contact plate, is capable of obtaining a sufficient separating distance between the two contacts, thereby attaining a positively open state therebetween.

It is still a further object of the invention to provide a cam operated switch comprising a plurality of switches including a number of plate terminals which project from a retainer means with all the surfaces of the terminals arranged in parallel to each other so as to minimize the dimensions of the plug-in type connector to be connected thereto.

In accordance with the present invention, the above objects are accomplished by arranging the thickness of the first contact plate in the radial direction of the cam to be large so that it will be difficult for the first contact plate to become deformed in that direction. Accordingly, when the second contact plate moves toward the first contact plate and the two contacts are brought into contact with each other, the first contact plate remains in a stable state without escaping toward the cam. As a result, it becomes possible to obtain a predetermined contacting pressure between the two contacts simultaneously upon contact between the two contacts, thereby attaining a positively conductive state. Meanwhile, when the second contact plate moves in the direction of being separated from the first contact plate and thereby causes the contacts to become open, the first contact plate remains in a stable state without moving toward the second contact plate. Consequently, a spacing having a distance substantially equivalent to the moving distance of the second contact plate can be obtained between the two contacts, thereby attaining a positively open state.

Additionally, each first contact plate is twisted by 90 degrees at the intermediate portion. Therefore, it is possible to realize the following two features simultaneously:

The first feature is to allow the surface direction of the terminal of each first contact plate to be arranged in parallel to that of the terminal of the second contact plate, so that all the terminal surface directions of the plural switches are arranged in parallel. As a result, it is possible to minimize the height dimension of the connector connected thereto in the direction that terminals of the first and second contact plates are arranged one above the other.

The second feature is to allow the surface direction of the part of the first contact plate projecting from the retainer toward the cam to match the movement direction of the second contact plate relative to the first contact plate, so that it is possible to markedly increase the rigidly of the first plate in that direction and therefore the first contact plate can support by itself the pressing force applied from the second contact plate when the second contact plate is brought into pressure contact with the first contact plate. In this case, the free end of the first contact plate will not be bent toward the cam drum. As a result, it is possible to obtain a stable electric conduction through between the first and second contact plates. Further, the free end of the first contact plate will not be brought into contact with the cam and never applies a brake force to the rotatable cam.

Other objects and advantages of the invention will become apparent during the following discussion of the accompanying drawings.

BRIEF DESCRIPTION OF THE DRAWINGS

FIG. 12 is an exploded perspective view showing the three contact plates of the switch;

FIG. 13 is an exploded perspective view illustrating a relationship among the first contact plate, a contact, and a guide member;

FIGS. 14(*a*) and 14(*b*) are cross-sectional views illustrating the process of installing contacts, taken in relation to line VII—VII.

DESCRIPTION OF THE PREFERRED EMBODIMENTS

Figure 1:
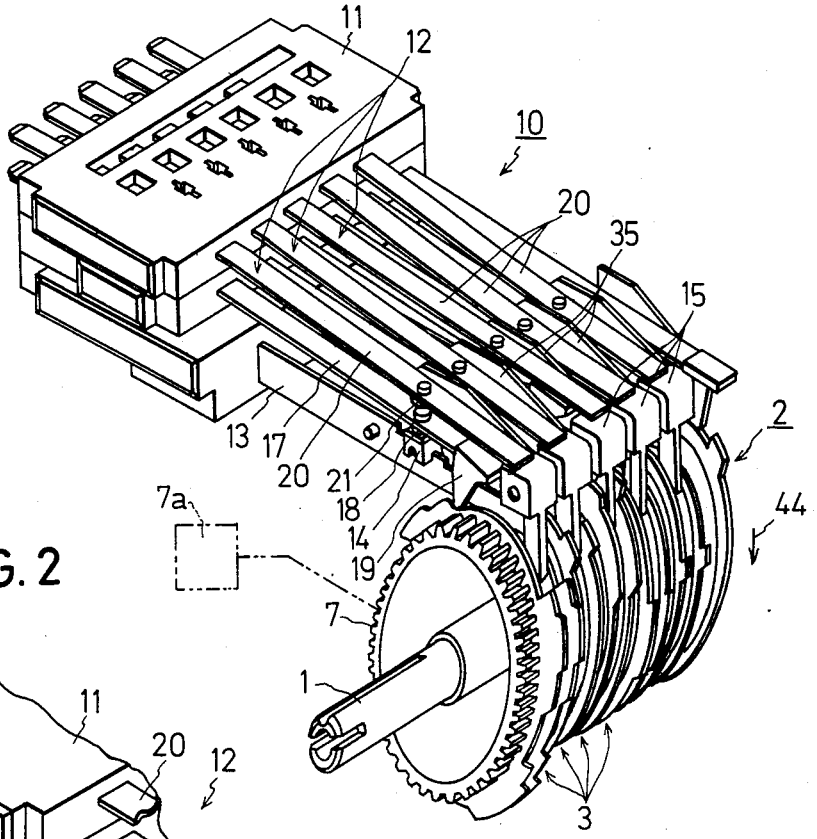
FIG. 1 is a perspective view of a cam operated switch embodying the present invention.
Figure 4:
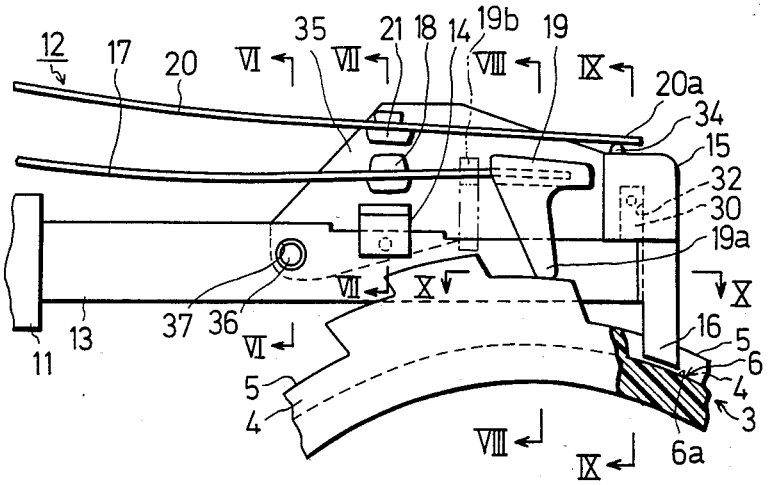
FIG. 4 is a front elevational view of the cam and the switch illustrating a relationship therebetween.
Figure 5:
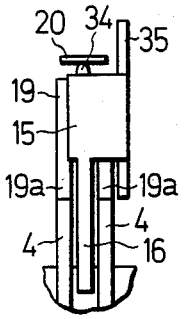
FIG. 5 is a right-hand side elevational view of FIG. 4.
Figure 6:
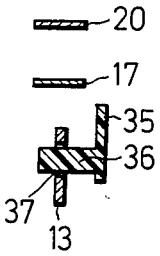
FIG. 6 is a cross-sectional view taken along the line VI—VI.

In FIGS. 1 to 16, reference numeral 1 denotes a camshaft, while reference numeral 2 denotes a multilayered cam integrally formed with the camshaft 1 and comprises a plurality of juxtaposed cams 3. The camshaft 1 and the multilayered cam 2 are formed of an insulating material having good heat-insulating and abrasion-resisting properties, e.g. polyacetal resin. Each cam 3 has cam elements 4, 4 juxtaposed in relation to each other and has a guide groove 6 therebetween. The peripheral surface of the cam element 4 constitutes a cam surface 5. Reference numeral 7 denotes a gear integrally formed with the multilayered cam 2, and is arranged such as to be rotatively driven by a known clock mechanism *7a* including a timer motor. Reference numeral 10 denotes juxtaposed switches constituted by a plurality of switches 12 each retained by a retainer 11. Each switch 12 is disposed on the side of the peripheral surface of each cam 3 in such a manner as to correspond with the same. In each of these switches 12, reference numeral 13 denotes a first contact plate; 14, a contact fixed thereto; and 15, a guide member fixed to the distal end of the contact plate 13. In this guide member 15, reference numeral 15*a* denotes a principal member for installation, with which a guide piece 16 is integrally formed. The tip of the guide piece 16 is situated inside a guide groove 6 in such a manner as not to come into contact with a groove bottom 6*a*, as shown in FIG. 4. Reference numeral 17 denotes a second contact plate which is capable of moving in the radial direction of the cam; 18, a contact fixed thereto; and 19, a driven member fixed to the distal end of the second contact plate 17 and is formed of an insulating material having heat insulating and incombustible properties, e.g. a nylon resin reinforced by glass fibers mixed therein. The driven member 19 is formed in a straddling manner so as to constitute a bifurcate piece, and the ends of the respective legs 19*a*, 19*a* thereof are arranged such as to abut the cam surfaces 5, 5. Incidentally, the driven member 19 may be arranged such as to perform only a driven operation with respect to the cam surface 5 by removing one of the two legs shown in FIG. 8. In that case, as shown by reference numeral 19*b* in FIG. 4, an arrangement may be made in such a manner that a bifurcate piece which is separate from the driven member 19 is fixed to the second contact plate 17, and the bifurcate piece 19*b* is made to straddle the first contact plate 13. Reference numeral 20 denotes a third contact plate, and 21, a contact fixed thereto. Each of the aforementioned contact plates 13, 17, and 20 is formed of a known contact plate material (e.g. phosphor bronze) having flexible properties. As shown in FIG. 1, the first contact plate 13 is formed in such a manner that its dimension in the axial direction of the cam 3 is made small, while its dimension in the radial direction of the cam 3 is made large, so that the first contact plate 13 can be deformed relatively easily in the axial direction and cannot be deformed readily in the radial direction.

Further, as shown in FIG. 13, the end of the first contact plate 13 remote from the projection 30 for mounting a guide member 15 serves as a terminal 13*a*. The intermediate portion of the first contact plate 13 is twisted by 90 degrees so that the surface direction of the terminal 13*a* is perpendicular to that of the portion 13*b* extending toward the cam.

Therefore as shown in FIG. 13, the part 13*b* of the first contact plate 13 which extends towards the cam has a flat shape which is defined by dimensions which extend in the longitudinal direction of the member and in the direction which the second contact plate 17 moves to and fro in relation to the first contact plate. Further, as shown in FIGS. 1 and 13, the second part 13*a* of the first contact plate 13, has a flat shape which is defined by dimensions which extend in the longitudinal direction of the contact plate and in the direction perpindicular to the direction of movement of element 17, that is, the surface of part 13*a* lies parallel to the corresponding part of contact plate 17, so that all switch terminals lie parallel to each other.

Description will be made of the structure of the contact 14 for installation to the first contact plate 13. First, the contact 14 is constituted by a base member 24 and a contact member 25 fixed thereto. The base member 24 is made of a softer material, such as copper, than that of the contact plate 13, and has a fitting groove 26 for fitting the contact plate 13. Meanwhile, the contact member 25 is made of a material having good conductivity, e.g. a silver nickel alloy, a silver-cadmium alloy, or silver. Reference numeral 23 denotes a fitting hole bored in the contact plate 13, while reference numeral 27 denotes a fitting member formed by deforming the base member 24 and located inside the fitting hole 23, as will be described later.

Now, description will be made of the structure of the guide member 15 for installation to the first contact plate 13. Reference numeral 30 denotes a projection formed integrally with the contact plate 13, and has a fitting hole 31 bored therein. Reference numeral 32 denotes an insertion hole bored in the principal member 15a for installation, while reference numeral 33 denotes a fitting member formed by deforming a part of the principal member 15*a* for installation and is located inside the fitting hole 31.

Figure 7:
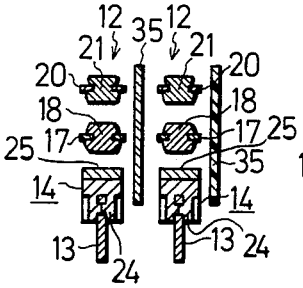
FIG. 7 is a cross-sectional view taken along the line VII—VII.
Figure 8:
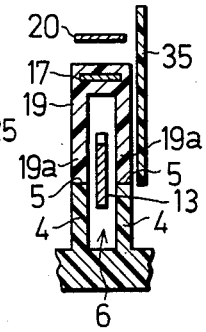
FIG. 8 is a cross-sectional view taken along the line VIII—VIII.
Figure 9:
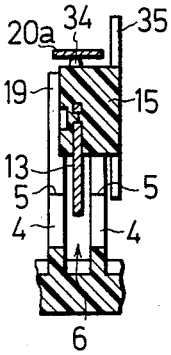
FIG. 9 is a cross-sectional view taken along the line IX—IX.

Furthermore, reference numeral 34 denotes a receiving portion formed such as to project from the guide member 15 and adapted to receive the distal end 20*a* of the third contact plate 20. Reference numeral 35 denotes a partition plate fixed to the guide member 15 and is formed integrally with the principal member 15*a* for installation. As shown in FIG. 7, this partition plate 35 is located between the adjacent switches 12, 12 so as to electrically insulate the contacts 14, 18, and 21 in these switches. Reference numeral 36 denotes a projection projecting from the partition plate 35 and inserted in a throughhole 37. The purpose of this is to preclude the partition plate 35 from becoming offset in the radial direction of the cam 3. Incidentally, the guide member 15 and the partition plate 35 are formed of an insulating material having heat-insulating and incombustible properties, such as nylon resin reinforced by mixing glass fibers therein.

Next, description will be made of the procedure of installing the contact 14 to the first contact plate 13 with reference to FIG. 14. First, as shown in FIG. 14(*a*), the contact 14 is placed on the contact plate 13 in such a manner as to cover the same so that the upper edge portion of the first contact plate 13 is situated in the fitting groove 26. Then, pressure is applied to the both sides of the base member 24 that correspond to the fitting hole 23, as shown by arrows 41, thereby subjecting these portions to deformation, as shown in FIG. 14(*b*). As illustrated in the figure, this causes a portion of the base member 24 to project into the fitting hole 23 so as to constitute the fitting member 27 fitted therein, which completes the fixing of the contact 14 to the contact plate 13. Incidentally, the above-described operation for causing deformation can be effected by pressing forming dies 46, 46 against the base member 24 by using a known press means.

Figure 15A:
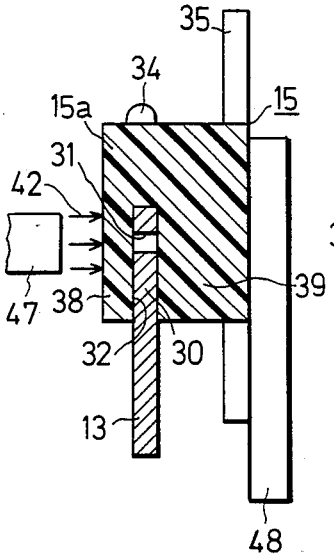
FIGS. 15(*a*) and 15(*b*) are cross-sectional views illustrating the process of installing the guide member, taken in relation to lines IX—IX.
Figure 15B:
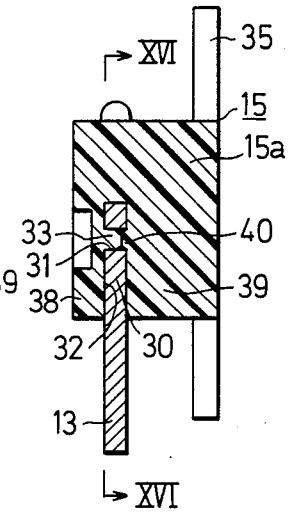
Figure 16:
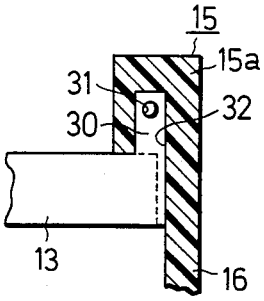
FIG. 16 is a cross-sectional view taken along the line XVI—XVI.

The fixing of the guide member 15 to the first contact plate 13 is carried out in the same procedure as that for the contact 14 by the use of a forming die 47 and a receiving plate 48, as shown in FIG. 15. Accordingly, a redundant explanation will be omitted. Incidentally, in this case, the plastic deformation of the guide member 15 by the application of pressure 42 is carried out with respect to only the side wall 38 having a smaller thickness, of the two side walls 38, 39 of the inserting hole 32, as shown in FIG. 15(*a*). Consequently, the fitting member 33 projects from the side wall 38, as shown in FIG. 15(*b*). In this case, the projection 30 is pressed against the side wall 39 having a greater thickness via the side wall 38 by the application of the pressure. In consequence, a projection 40 projecting slightly toward the fitting hole 31 is formed.

Figure 2:
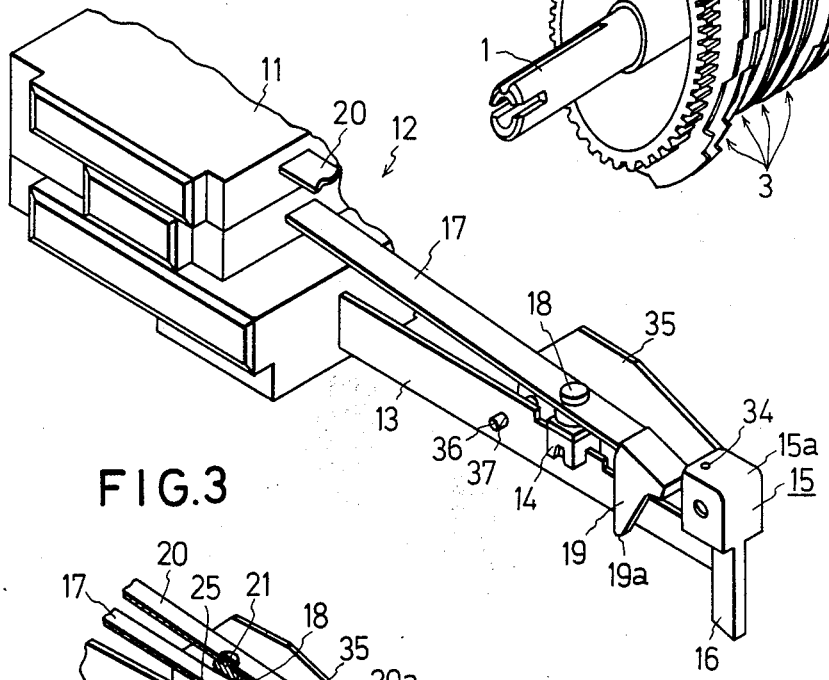
FIG. 2 is a perspective view of one switch.
Figure 3:
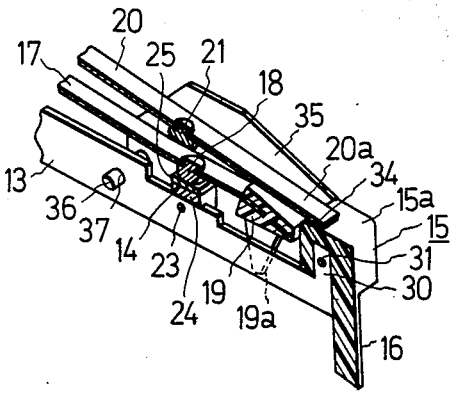
FIG. 3 a vertically cut-away cross-sectional perspective view of FIG. 2.

In the above-described arrangement, the multilayered cam 2 is rotated in the direction of an arrow 44 shown in FIG. 2 by means of the clock mechanism 7*a*. This rotation causes the driven member 19 abutting the cam surface 5 of each cam 3 to reciprocate in the radial direction of the cam in response to the concave and convex portions of the cam surface 5. As a result, the second contact plate 17 repeats its reciprocating movement toward and away from the first contact plate 13 and the third contact plate 20, so that the contact 18 repeats its contacting and separating strokes with respect to the contacts 14, 21. In this case, the dimension of the first contact plate 13 in the radial direction of the cam 3 is made large, so that is is difficult to be deformed easily in that direction. For this reason, even if the second contact plate 17 moves toward the first contact plate 13 and causes the contact 18 to come into contact with the contact 14, the contact 14 maintains its position in the radial direction of the cam 3 (is not displaced toward the side of the cam 3). Accordingly, the moment when the contact 18 is brought into contact with the contact 14, a large contacting pressure is obtained for the two contacts 18, 14, thereby preventing the occurrence of chattering at the moment of energization. In addition, in an energized state the contact resistance between the two contacts 18, 14 is checked to an extremely small level owing to the large contacting pressure, thereby attaining a favorable condition of electrical conductance.

Meanwhile, when the second contact plate 17 moves in the direction of separating from the first contact plate 13, causing the contact 18 to be separated from the contact 14, the contact 14 does not move toward the side of the contact 18. In consequence, a contacting pressure between the two contacts 18, 14 becomes instantly zero, thereby preventing the occurrence of chattering at the moment of opening. In addition, since the contact 14 does not move toward the side of the contact 18, it becomes possible to secure a sufficient distance between the two contacts 18, 14 in an open state, so that a favorable condition of electrical insulation is ensured for the two contacts 18, 14.

In the above-described cam operated switch, the partition plate 35 is interposed between the adjacent switches 12, as shown in FIG. 7. For this reason, when the contacts 18, 14 of each switch 12 are brought into contact with or separated from each other, even if an arc is generated there, the application of the arc to the contacts of the adjacent switches 12 can be prevented by the partition plate 35 installed to the first contact plate 13. Consequently, the electrical interference between the adjacent switches 12 owing to arcs can be prevented. This has an advantage in maintaining the electrical independence of the respective switches 12 even if the switches 12 are disposed close to each other in consequence of a tendency to make the axial dimension of the multilayered cam 2 compact.

The partition plate 35 is installed to the first contact plate 13 which is extremely difficult to be displaced in the radial direction of the cam 3, as described earlier. For this reason, the condition of disposition of the partition plates between the adjacent switches 12 is maintained stably, so that extremely high reliability is ensured for the prevention of interference between the respective switches 12.

In a case where the cam operated switch having the aforementioned arrangement is used by being incorporated in such an apparatus as an electric washing machine, the multilayered cam 2 sometimes assumes a very low or high temperature. For instance, when the aforementioned apparatus is used in a cold district and when the temperature drops as low as minus 20° C., the temperature of the multilayered cam 2 also drops to the same level if the apparatus is not operated. Meanwhile, the apparatus is operated, the temperature of the multilayered cam 2 becomes, for instance, 60° to 70° C. or thereabout. If the temperature of the multilayered cam 2 changes by 80° C. or more, a substantially large dimensional change takes place in the axial direction thereof. The dimensional change is such that any of the cams 3 of the multilayered cam 2 is displaced axially by the switch 12 actuated by that cam 3 to such an extent that the corresponding positional relationship between the two becomes out of order. However, even if such an axial displacement occurs in the cam 3, a favorable tracing performance is maintained for the driven member 19 of the switch 12 relative to the cam surface 5 of the cam 3.

Figure 10:
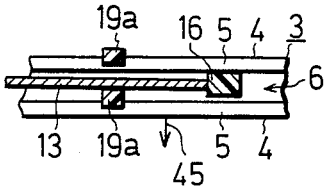
FIG. 10 is a cross-sectional view taken along the line X—X.
Figure 11:
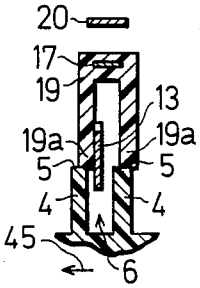
FIG. 11 is a view similar to FIG. 8 and illustrates a state in which the cam is displaced in the axial direction.

In other words, as shown in FIGS. 10 and 11, if the cam 3 is displaced in the direction of an arrow 45, the guide piece 16 located in the guide groove 6 also moves in the same direction. This causes the contact plate 13 to bend in the direction of the arrow 45. Then, since the driven member 19 is in a state of straddling the first contact plate 13, the leg 19*a* of the driven member 19 is pushed by the side wall of the first contact plate 13 to slightly move laterally. (In this case, the second contact plate 17 is torsioned slightly.) As a result, the tip of the leg 19a of the driven member 19 is maintained as mounted on the cam surface 5. For this reason, it becomes possible for the driven member 19 to properly trace the concave and convex portions of the cam surface 5.

Incidentally, the favorable tracing performance of the driven member 19 with respect to the cam surface 5 can be maintained even if the overall multilayered cam 2 is displaced in its axial direction owing to the presence of an axial clearance between the camshaft 1 and a known bearing supporting the same.

The first contact plate 13 of each switch 12 in the above-described cam operated switch has a small thickness in the direction thereof parallel with the axial direction of the cam 3, as mentioned above. However, the contact 14 provided to the first contact plate 13 is secured to the first contact plate 13 in such a manner as to straddle the same. Therefore, the planar configuration of the contact 14 may be made large. For this reason, it becomes possible for the contact 14 to secure a large surface of contact with the contact 18, thereby ensuring a favorable state of electrical conductance during the contact of the two contacts 18, 14.

Figure 17:
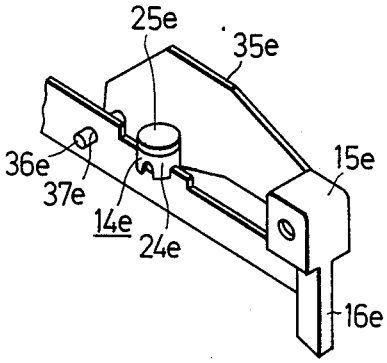
FIG. 17 is a perspective view illustrating an modification of a contact having a different configuration.
Figure 18:
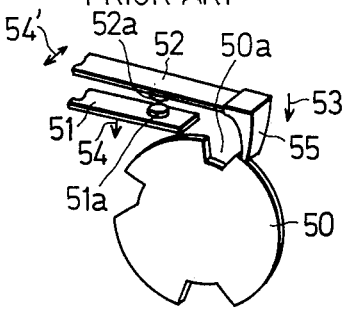
FIG.18 PRIOR ART
FIG. 18 is a perspective view illustrating a conventional cam operated switch.

FIG. 17 illustrates a modification of the configuration of the contact fixed to the first contact plate, in which a contact having a round shape in terms of its planar configuration is provided.

Incidentally, as for those portions that are considered to have the same or equivalent arrangement in terms of their functions as those shown in the preceding drawings, the alphabet e is provided to the same reference numerals of the preceding drawings, and an explanation thereof will be omitted.

As many apparently widely different embodiments of this invention may be made without departing from the spirit and scope thereof, it is to be understood that the invention is not limited to the specific embodiments thereof except as defined in the appended claims.

What is claimed is:

1. A cam operated switch including a plurality of cams juxtaposed concentrically, the peripheral surface of each of said cams constituting a cam surface, and a plurality of switches respectively corresponding to said cams disposed aside the peripheral surfaces of said cams, each of said switches including a first contact plate located in a position close to its respective cam and a second contact plate located in a position farther from said cam and biased towards said cam, said first and second contact plates each being formed of a single plate wherein the intermediate portion of each of these contact plates is disposed in a retainer means with a first part of each plate projecting in a longitudinal direction from the retainer means towards the cam and a second part projecting from the retainer means in said longitudinal direction away from said cam, the end of the second part of each plate forming a plate end terminal which is connectable with a plug-in type connector, the surfaces of the plate end terminals of all said switches being arranged parallel to each other.

said second contact plate of said each switch being provided with a driven member which is arranged to slidably abut said cam surface in such a manner that, when said cam is rotated, said second contact plate is displaced in the radial direction of said cam in response to concave and convex portions of said cam surface, causing said second contact plate to move towards or away from said first contact plate, each of said first and second contact plates having a contact fixed thereto, said contacts respectively contacting with and becoming separated from each other as said first and second plates move towards and away from each other;

the first part of each said first contact plate having a relatively flat shape which is defined by dimensions which extend in said longitudinal direction of said contact plate and in the direction that said second contact plate moves to and fro relative to the first contact plate, and the second part of said first contact plate also having a relatively flat shape which is defined by dimensions which extend in said longitudinal direction of said contact plate and in a direction which is perpendicular to the direction that said second contact plate moves to and fro relative to the first contact plate and also perpendicular to said relatively flat shape of said first part of said first contact member.

2. The cam operated switch of claim 1 wherein said respective switches which correspond to concentrically juxtaposed cams are adjacent each other and wherein a partition plate is fixed to the first contact plate of each switch, said partition plate being interposed between said adjacent switches so that when an arc occurs at the switch contacts, the application of said arc to adjacent switches can be prevented.

3. A cam operated switch according to claim 1, wherein the contact which is fixed to said first contact plate has a fitting groove for fitting onto said first contact plate formed on the rear surface of said contact and wherein said first contact plate is fitted into said groove so that said contact straddles said first contact plate.

4. A cam operated switch according to claim 1, wherein said driven member is formed in a bifurcate shape, and said bifurcate driven member is made to straddle said first contact plate.

* * * * *